US005431767A

United States Patent [19]

Koza et al.

[11] Patent Number: 5,431,767

[45] Date of Patent: Jul. 11, 1995

[54] APPARATUS FOR APPLYING ADHESIVE TAPE

[75] Inventors: Randall G. Koza, Maplewood, Minn.; Bruce G. Robinson, Hudson, Wis.; Steven J. Rossini, Hugo, Minn.

[73] Assignee: Minnesota Mining and Manufacturing Company, St. Paul, Minn.

[21] Appl. No.: 112,891

[22] Filed: Aug. 27, 1993

[51] Int. Cl.[6] ..... B32B 35/00

[52] U.S. Cl. ..... 156/350; 156/505; 156/523; 156/526; 156/530; 156/545; 156/574; 156/577

[58] Field of Search ..... 156/523, 505, 525, 530, 156/545, 574, 350, 577, 526

[56] References Cited

U.S. PATENT DOCUMENTS

| | | | |
|---|---|---|---|
| 3,066,723 | 12/1962 | Remington et al. | 156/522 |
| 3,406,084 | 10/1968 | Varga | 156/522 |
| 3,630,346 | 6/1970 | Burnside | 206/56 |
| 3,672,476 | 6/1972 | Hendershot | 192/12 D X |
| 3,765,992 | 10/1973 | Stageberg | 156/521 |
| 3,824,143 | 7/1974 | Cooper et al. | 156/545 X |
| 3,871,940 | 3/1975 | Antonioni | 156/523 X |
| 3,939,034 | 2/1976 | Tanaka et al. | 156/523 X |
| 3,957,567 | 5/1976 | Pursell et al. | 156/523 X |
| 4,177,959 | 12/1979 | Lancaster et al. | 242/58.2 |
| 4,284,463 | 8/1981 | Wright | 156/502 |
| 4,328,061 | 5/1982 | Off et al. | 156/523 X |
| 4,398,379 | 8/1983 | Burford | 53/77 |
| 4,459,170 | 7/1984 | Kerwin | 156/361 |
| 4,526,638 | 7/1985 | Clements | 156/505 X |
| 4,555,288 | 11/1985 | Nozaka | 156/191 |
| 4,582,558 | 4/1986 | Antonson | 156/523 |
| 4,597,820 | 7/1986 | Nozaka | 156/353 |
| 4,636,276 | 1/1987 | Nozaka | 156/523 X |
| 4,683,022 | 7/1987 | Watanabe et al. | 156/505 |
| 4,861,411 | 8/1989 | Tezaka | 156/344 |
| 4,905,924 | 3/1990 | Moore | 242/58.5 |
| 4,980,011 | 12/1990 | Gruber et al. | 156/361 |
| 5,076,878 | 12/1991 | McLees et al. | 156/353 |
| 5,212,002 | 5/1993 | Madrzak et al. | 428/40 |

FOREIGN PATENT DOCUMENTS

| | | | |
|---|---|---|---|
| 2025473 | of 1991 | Canada . | |
| 2069247 | 12/1992 | Canada . | |
| 0181280A1 | 5/1986 | European Pat. Off. | B65H 21/00 |
| 0418527A2 | 8/1990 | European Pat. Off. . | |
| 0512196A1 | 11/1992 | European Pat. Off. | B65H 19/28 |
| 330567 | 10/1973 | Germany . | |
| 2331125 | 8/1974 | Germany . | |
| 2318353 | 10/1974 | Germany . | |
| 2337663 | 2/1975 | Germany . | |
| 3112775A1 | 10/1982 | Germany . | |
| 3402582A1 | 8/1985 | Germany . | |
| 3614264A1 | 10/1987 | Germany . | |
| 2025376 | 1/1980 | United Kingdom . | |

*Primary Examiner*—David A. Simmons
*Assistant Examiner*—M. Curtis Mayes
*Attorney, Agent, or Firm*—Gary L. Griswold; Walter N. Kirn; Mark W. Binder

[57] ABSTRACT

An apparatus for applying a length of adhesive tape from a supply of adhesive tape along the length of a leading edge of a roll of web material includes a cutting mechanism for cutting the length of web material to form a length of leading edge on the roll of web material. An application mechanism of the apparatus is configured to remove adhesive tape from the supply of adhesive tape and apply adhesive tape along a length of the leading edge of the web material. A take-up mechanism removes a liner from the adhesive tape during the application of the adhesive tape to the leading edge. A buffing mechanism contacts the adhesive tape applied along the length of the leading edge to insure contact between the adhesive tape and an outer layer portion of the roll of web material that is directly adjacent the leading edge. A cutoff mechanism cuts the adhesive tape to form the length of adhesive tape along the leading edge of the web material.

22 Claims, 6 Drawing Sheets

MOTOR
MOTOR
MOTOR
DRIVE MECHANISM
CONTROLLER
A 10
12
14
16
22
26
28
30
32
34
36
38
40
41
42
44
48
49
64
65
66
68
70
72
74
76
78
80
83
84
86
88
90
B
4
4
5
5

APPARATUS FOR APPLYING ADHESIVE TAPE

BACKGROUND OF THE INVENTION

The present invention relates generally to an apparatus and method for applying a strip of material to an elongate member. In particular, the present invention is an apparatus and method for applying flying splice, pressure sensitive, adhesive tape to a leading edge of a roll of web material.

In the newspaper and magazine publishing industry, the lengths of web material (i.e., paper), from which individual newspapers or magazines are printed, are contained on rolls (i.e., elongate members). Typically, the length of web material of a roll is fixed, and the web material is continuous from its trailing edge at the core of the roll to its leading edge at the periphery of the roll. The length of web material from an individual roll is fed into a printing apparatus where print and/or pictures are applied to the web material in a continuous, automated process. Next, the length of web material is cut into sheets of desired size and then these sheets are assembled into individual newspapers or magazines. The cutting of the sheets and the assembling of the sheets into their final print medium format is once again, a continuous, automated process. Typically, during the continuous process of printing, cutting and assembling of the print medium, the length of web material travels at speeds of between 2000 and 3000 feet per minute. Hence, large numbers of individual newspapers or magazines can be produced in a relatively short period of time.

A disadvantage in the use of the rolls of web material occurs when splicing a leading edge of a "new" roll of web material to the trailing edge of an "old" roll of web material currently traveling through the continuous printing, cutting and assembling process. This type of new-to-old roll connection is referred to as a "flying splice", and is a splice made between an expiring or leading roll of web material and a new or following roll of web material in a continuous manner without reducing either the equipment speed or the speed of the web. Typically, to splice the leading edge of the new roll to the trailing edge of the old roll, one or more pieces of adhesive tape are manually applied to the leading edge of the new roll of web material. Adhesive, such as pressure sensitive adhesive, on a bottom surface of the tape secures the tape to the leading edge. With the tape secured to the leading edge of the new roll, the leading edge of the new roll is brought into contact with the old roll, where adhesive, such as pressure sensitive adhesive, on the top surface of the tape secures the leading edge of the new roll of web material to the trailing edge of the old roll of web material. Once the splicing process is complete, movement of the web material of the old roll, through the apparatus performing the printing, cutting and assembling process, acts to continuously and automatically thread the web material of the new roll into the printing, cutting and assembling apparatus. Due to the complex and mostly manual nature of the process for applying a piece of flying splice adhesive tape to the leading edge of a roll of web material, the process is tedious, cumbersome and time consuming. Operator time to manually prepare and apply a flying splice to a leading edge of web material may range from about 4–10 minutes for small rolls such as may be used in magazine printing and 15–20 minutes for large rolls such as may be used in newspaper printing.

In addition, the hand work required by one or more people to manually apply a piece or pieces of flying splice adhesive tape to a length of web material is not conducive to the accurate positioning of the tape on the leading edge of the web material. Moreover, adhesive (particularly pressure sensitive adhesive) on the top and bottom surfaces of the flying splice adhesive tape tends to adhere to the leading edge of the web material virtually on contact, making repositioning of the tape difficult, and thereby further complicating the process of accurately aligning the tape on the leading edge of the web material. Misalignment of the flying splice adhesive tape on the leading edge of the web material may result in the leading edge of the new roll being incorrectly applied to the trailing edge of the old roll, which may cause the new web of material to be improperly threaded into the apparatus performing the printing, cutting and assembling process. Incorrect feeding of the new web material into the apparatus may cause the apparatus to seize resulting in machine down time and lost production time.

An apparatus for automatically applying flying splice adhesive tape to a leading edge of a roll of web material has been developed, as described in Canadian Patent Application 2,069,247 to Norbert et al. Disclosed is an apparatus for preparing a leading edge of a new roll of web material for a flying splice. The apparatus of Norbert et al. includes a base plate for carrying a knife support block that extends substantially parallel to the axis of rotation of the roll of web material. A cutting knife of the cutting block forms the cut leading edge of the roll of web material while a perforating blade forms a perforated region in the web material spaced from the leading edge. The cutting knife and perforating blade are parallel to one another and to the axis of rotation of the web material roll. The base plate further carries an adhesive application block for holding adhesive. The adhesive application block applies a first adhesive to a lower surface of the web material between the leading edge of the web material and the web material cuts made by the perforating blade. A connecting adhesive application roller applies a second adhesive to an upper surface of the web material adjacent the web material cuts made by the perforating blade but on a side of the cuts opposite to the first adhesive. The first adhesive secures the leading edge of web material to the next underlying layer of web material on the roll of web material. The second adhesive contacts and secures the leading edge of new roll web material to a trailing edge of an expiring roll of web material and web material separation occurs along the cuts made by the perforating blade. In operation, web material is rolled off of the roll to bring the web material into position on the splice preparation apparatus of Norbert et al. The leading edge and perforations are cut and the first and second adhesives are applied to the web material. The web material is then rewound onto the roll and the leading edge of web material is secured to the next underlying layer of web material on the roll of web material via the first adhesive. Unwinding and rewinding the web material off and on the roll may cause the web material wrinkles and misalignment due to inadvertent and misaligned adhesion of the first adhesive to the underlying layer of web material.

There is a need for an apparatus and a method for applying flying splice adhesive tape to a leading edge of a roll of web material. Specifically, the application apparatus should permit the tape to be applied to the leading edge of the web material quickly and with alignment accuracy when compared to prior manual and automatic procedures for applying flying splice adhesive tape. In addition, the application method should not be hand work intensive, cumbersome or tedious when compared to prior manual and automatic methods for applying splice tape to the leading edge of a length of web material.

SUMMARY OF THE INVENTION

The present invention is an apparatus and method for applying a length of adhesive tape from a supply of adhesive tape along the length of a leading edge of a roll of web material. The application apparatus includes a main frame configured to be positioned adjacent to the leading edge of the roll of web material. An application frame assembly is mounted on the main frame and is configured to be positioned adjacent to the leading edge of the roll of web material. The application frame assembly includes a support means for holding a supply of adhesive tape. An application mechanism of the frame assembly is configured to remove the adhesive tape from the supply of adhesive tape and apply a length of adhesive tape along a length of the leading edge of the roll of web material. A clutch mechanism applies a constant torque to the application mechanism to insure a wrinkle free leading edge of web material.

A take-up mechanism removes a liner from the adhesive tape prior to or during the application of the adhesive tape along the length of the leading edge of web material. The application frame assembly is preferably adapted to move relative to the main frame in a first linear direction along a length of the roll of web material and in a second linear direction opposite to the first direction back along the length of the roll. The application frame assembly further includes a cutting mechanism for cutting the length of web material to form the length of leading edge on the roll of web material. The cutting mechanism operates to form the length of leading edge as the application frame assembly moves along the length of the roll in the first linear direction.

The application mechanism further includes a buffing mechanism that is designed to contact the adhesive tape applied along the length of the leading edge to insure contact between the adhesive tape and an outer layer portion of the roll of web material that is directly adjacent the leading edge. The application mechanism and its buffing mechanism are preferably designed to operate as the application frame assembly moves back along the length of the roll in the second linear direction. A cutoff mechanism cuts the adhesive tape to form the length of adhesive tape along the leading edge of the web material subsequent to the adhesive tape being applied to the leading edge of the roll of web material.

This application apparatus and method allows flying splice adhesive tape to be applied to the leading edge of a roll of web material quickly while insuring alignment accuracy especially when compared to prior manual procedures for applying splice tape. The use of a clutch mechanism to insure constant torque at the point of contact between the application mechanism and the leading edge of web material insures that leading edge of the web material beneath the tape is wrinkle free. In addition, due to the automated nature of the application apparatus the hand work normally required to apply flying splice adhesive tape to the leading edge of a roll of web material can be virtually eliminated, thus resulting in a reduction of man hours to apply the splice tape to the roll of web material.

BRIEF DESCRIPTION OF THE DRAWINGS

The invention is further described with reference to the accompanying drawings, where like numbers refer to like parts in several views.

These drawing figures are provided for illustrative purposes only and are not drawn to scale, nor should they be construed to limit the intended scope and purpose of the present invention.

DETAILED DESCRIPTION OF THE PREFERRED EMBODIMENTS

Figure 1:
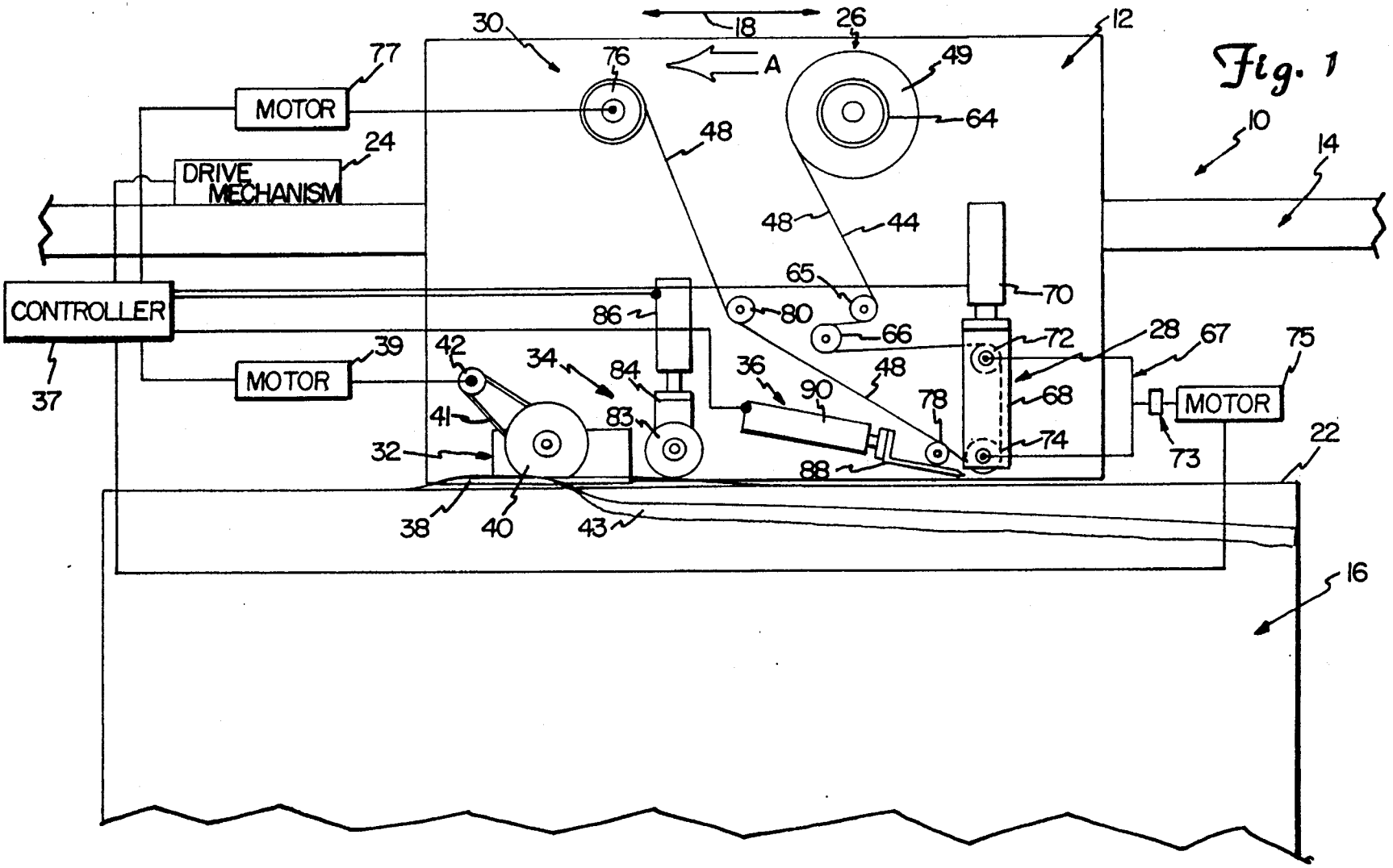
FIG. 1 is a side elevational view of an application apparatus in accordance with the present invention with a cutting mechanism shown forming a length of leading edge on a roll of a length of web material.
Figure 2:
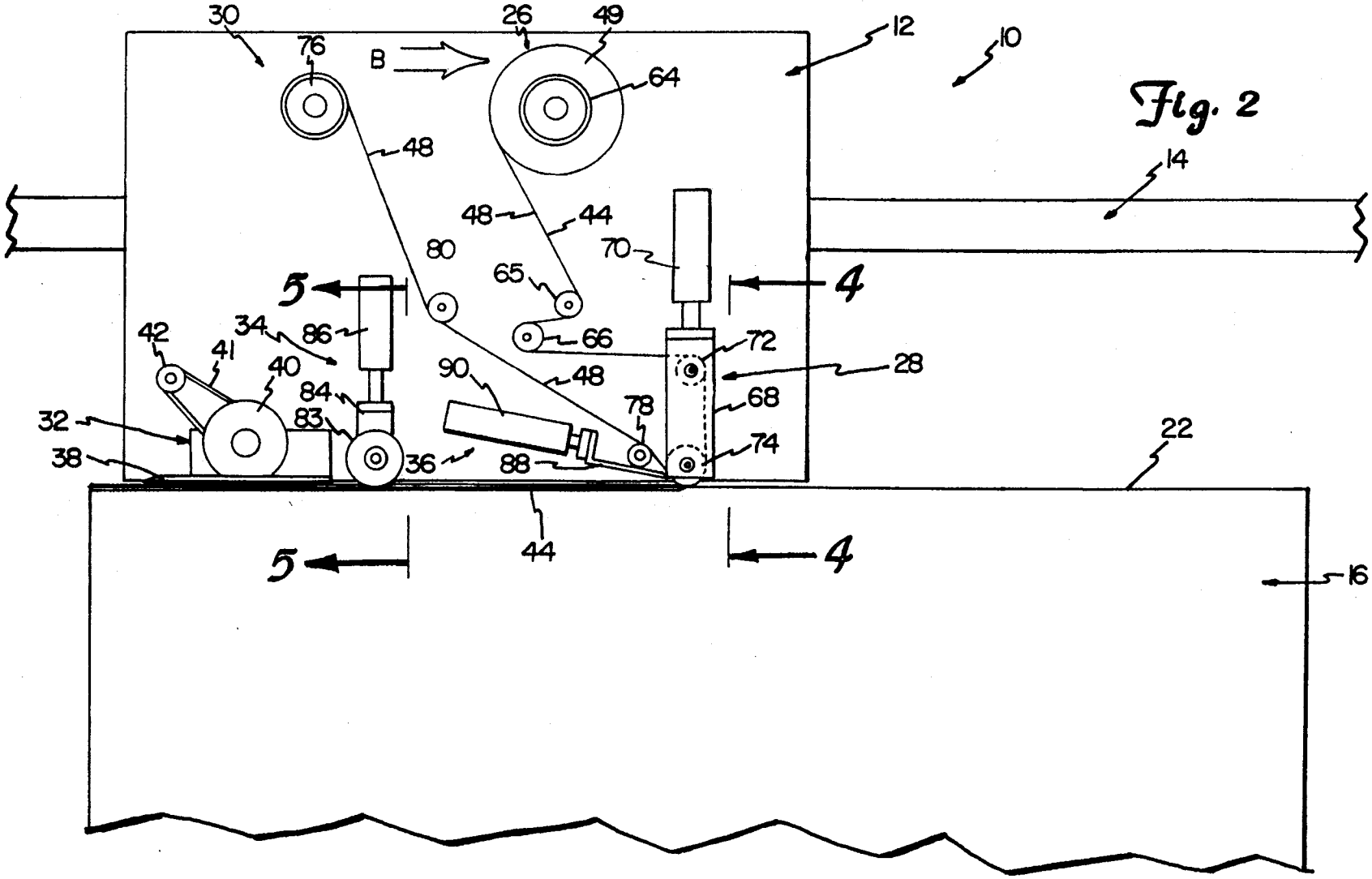
FIG. 2 is a side elevational view similar to FIG. 1 illustrating the operation of an application mechanism and a buffing mechanism.
Figure 5:
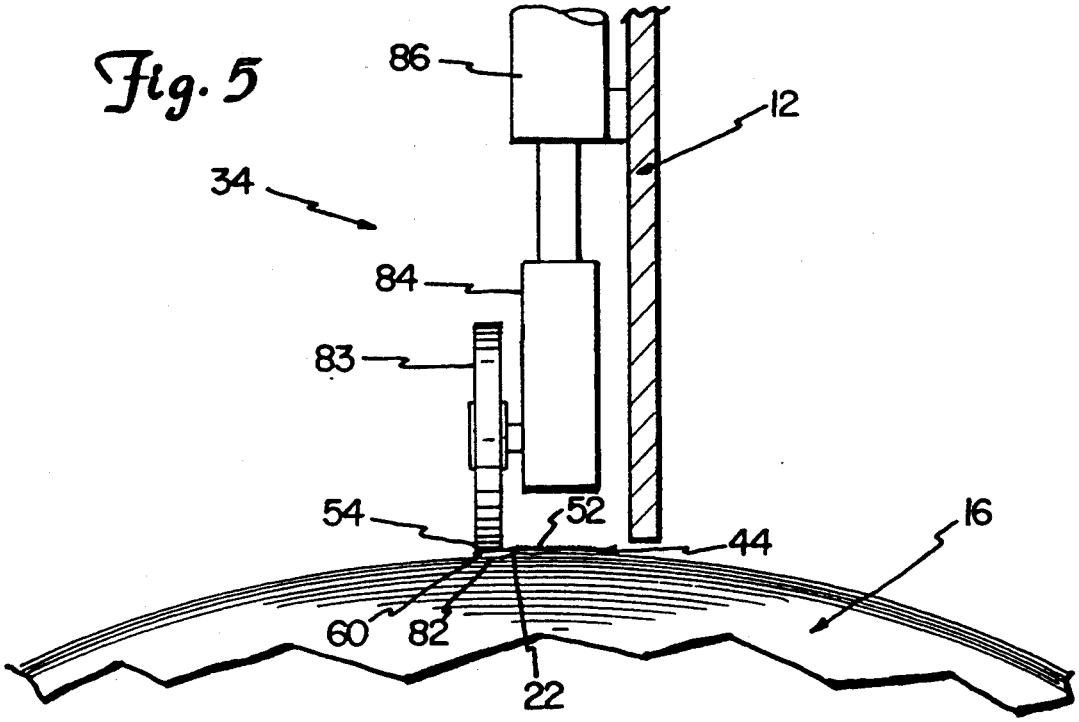
FIG. 5 is a sectional view taken along line 5—5 in FIG. 2.
Figure 6:
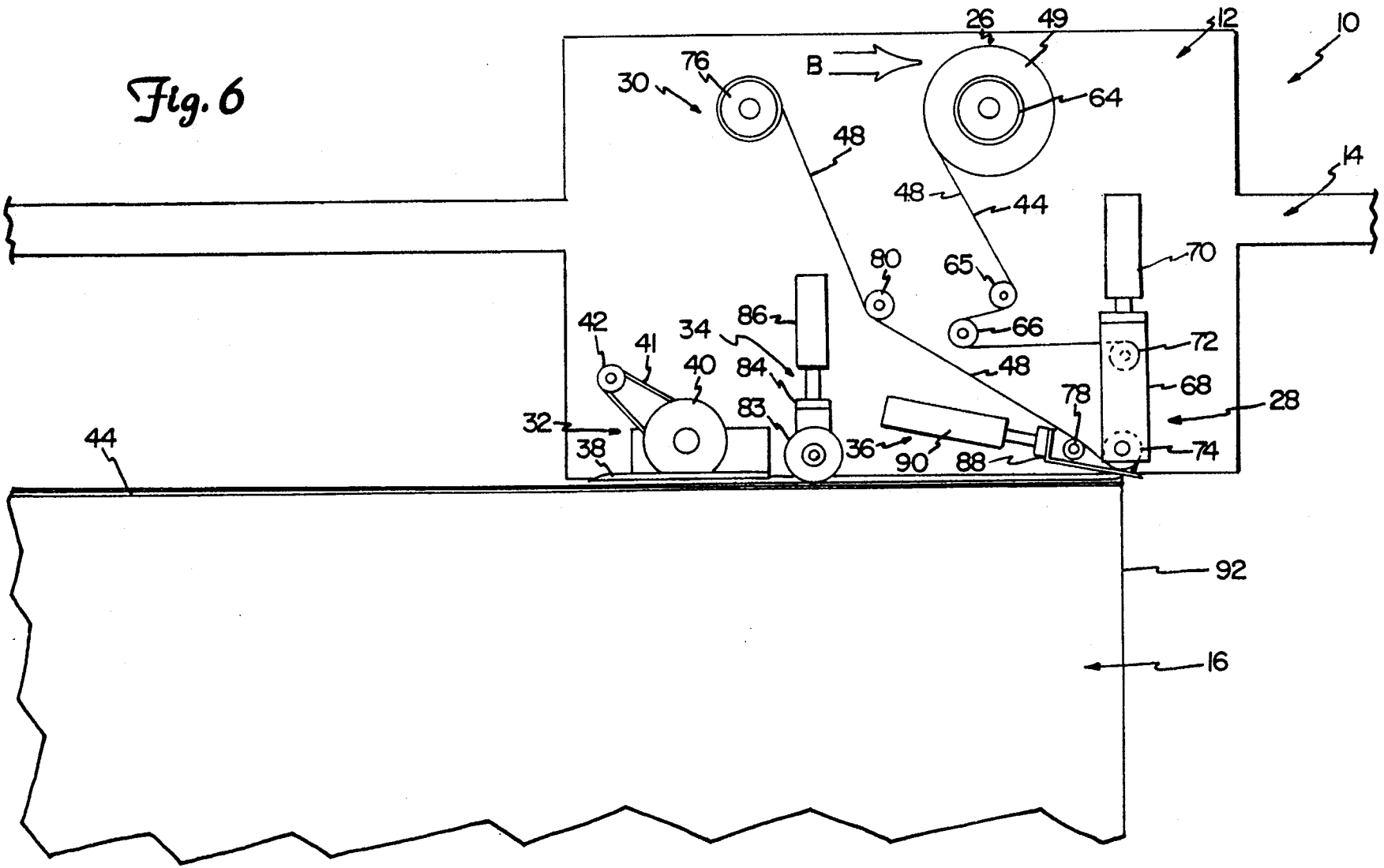
FIG. 6 is a side elevational view similar to FIG. 2 illustrating the operation of a cutoff mechanism.

An application apparatus 10 in accordance with the present invention is illustrated generally in FIGS. 1, 2 and 6. The apparatus 10 includes an application frame 12 movable relative to a main frame 14. As seen in FIGS. 1, 2 and 5, the application apparatus 10 is configured such that the application frame 12 can be disposed adjacent to a roll of web material 16. The application frame 12 is linearly moveable relative to the main frame 14 in opposite directions (as represented by double headed arrow 18 in FIG. 1) parallel to a leading edge 22 of the web material 16. A drive mechanism 24 mounted on the main frame 14 and coupled to the application frame 12 is configured to drive the application frame 12 in a first linear direction "A" (see FIG. 1) and in a second, opposite linear direction "B" (see FIGS. 2 and 6) along the roll of web material 16. The drive mechanism 24 is preferably mechanical, but may alternatively be hydraulic or pneumatic in nature. The drive mechanism 24 is controlled by a controller 37, such as a microprocessor, to precisely control the speed and direction of the application frame 12.

As will be described more clearly below, the application apparatus 10 operates in three steps: the leading edge preparation step (FIG. 1), the tape application step (FIGS. 2–5), and the tape cut-off step (FIG. 6) A number of mechanisms are mounted on the application frame 12 to perform these steps. The leading edge preparation step is performed by a web cutting mechanism 32. The tape application step is performed by a supply mechanism 26, an application mechanism 28, a take-up mechanism 30, and a buffing mechanism 34. The tape cut-off step is performed by a tape cut-off mechanism 36. The various mechanisms operate at varying times during the operation of the application apparatus 10. Accordingly, the controller 37 is connected to these various mechanisms, to effectuate the operation of the mechanisms. In addition, one or more drive mechanisms (e.g., motors) are operably connected to the controller 37 to provide power to a variety of the mechanisms.

FIG. 1 illustrates the application apparatus 10 during the leading edge preparation step. This step precisely forms the leading edge 22 on the roll of web material 16 as the application frame 12 is moved in direction "A" from a first end of the roll of web material 16 to a second end. The cutting mechanism 32 is used to form the leading edge 22 on the roll of web material 16 and is the only mechanism on the application frame 12 that is operating during the edge preparation step. The cutting mechanism 32 includes a cutting guide 38 and a circular cutting blade 40. The circular cutting blade 40 is driven by a motor 39 via a drive belt 41 and a drive sprocket 42. The motor 39 is coupled to and controlled by the controller 37. The circular cutting blade 40 rotates at a speed sufficient to cut the web material 16 to form the leading edge 22. The cutting guide 38 is disposed adjacent the cutting blade 40 and is configured to lift and/or support an uncut rough edge portion 43 of web material 16. The cutting guide 38 holds the uncut rough edge portion 43 of the web material away from the roll of web material 16 when the application frame 12 travels in linear direction "A". The cutting guide 38 thereby acts to create contact between the rotating blade 40 and the web material 16 to form the leading edge 22. Once the application frame 12 has travelled the full length of the roll of web material 16, the leading edge 22 is fully formed, the cut-away rough edge portion 43 is discarded and the motor 39 is shut down by the controller 37.

Figure 7:
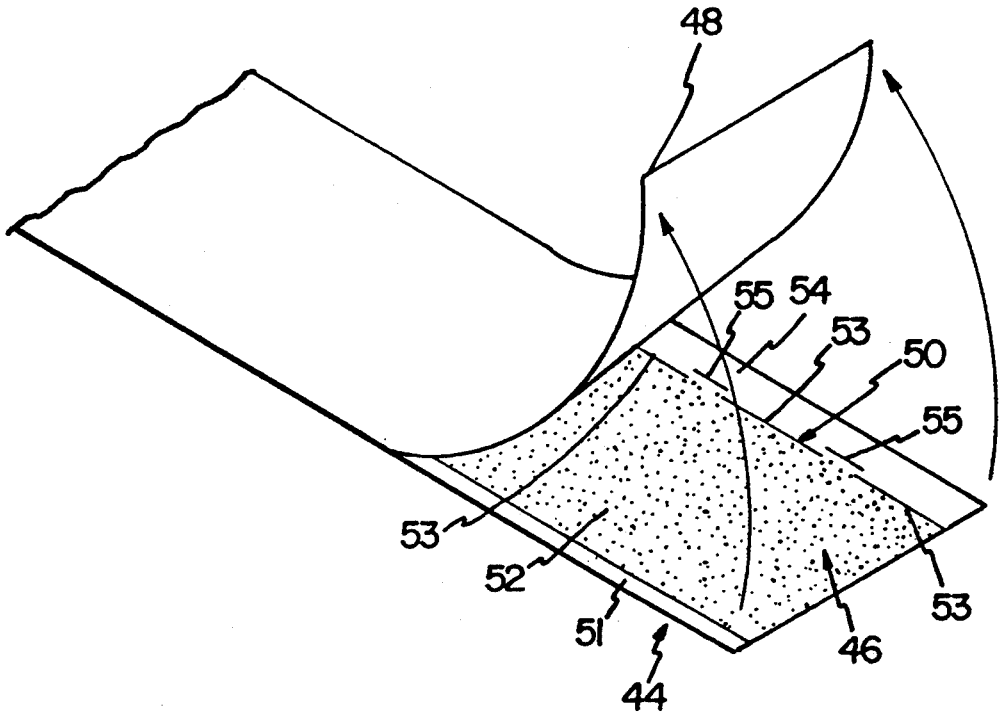
FIG. 7 is a perspective view of a top surface of flying splice adhesive tape usable with the application apparatus in accordance with the present invention.
Figure 8:
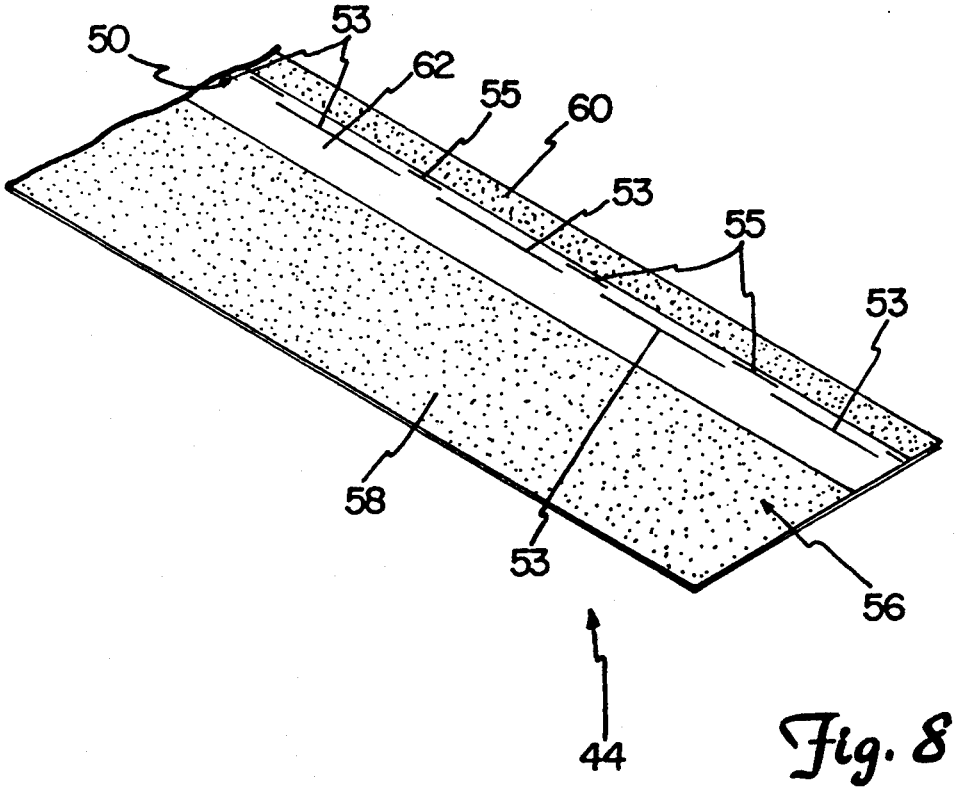
FIG. 8 is a perspective view of a bottom surface of the flying splice adhesive tape shown in FIG. 7.

The application apparatus 10 performs the tape application step after the leading edge preparation step is completed. FIGS. 2–5 show the application apparatus 10 during the tape application step (which takes place as the application frame 12 is moved in direction "B" from the second end of the roll of web material 16 back to the first end). However, a short description of the tape that is applied by the application apparatus 10 will provide a better understanding of the various functions performed by the application apparatus 10 during the tape application step. Accordingly, FIGS. 7 and 8 more clearly show the nature of the tape that is used in conjunction with the application apparatus 10. The tape has adhesive on both sides. FIG. 7 shows a top surface 46 of a pressure sensitive flying splice adhesive tape 44. A liner 48 is adhered to the top surface 46 so that the tape 44 and the liner 48 can be placed in a rolled configuration 49 like that shown in FIGS. 1, 2 and 6. A perforation pattern 50 extends throughout the length of the tape 44. On the top surface of the tape 44, the perforation pattern 50 separates a trailing edge tackified portion 52 from a trailing edge untackified or detackified portion 54. An end margin untackified or detackified portion 51 runs along an outer edge of the tackified portion 52. The perforation pattern 50 defines a controlled tape separation line for the new-to-old roll flying splice connection. As shown in FIGS. 7 and 8, a preferred perforation pattern is a series of offset long and short linear cuts 53 and 55, respectively, through the tape 44.

FIG. 8 shows a bottom surface 56 of the tape 44. The bottom surface 56 has a leading edge tackified portion 58, an outer layer tackified portion 60, and a leading edge untackified or detackified portion 62 bearing the perforation pattern 50 therein. A complete description of the tape 44 can be found in U.S. patent application Ser. No. 08/113,413 to Hall et, al. entitled FLYING SPLICE ADHESIVE TAPE filed on even date herewith and incorporated herein by reference thereto. It is to be understood that other flying splice adhesive tapes are usable with the application apparatus 10 of the present invention.

Figure 4:
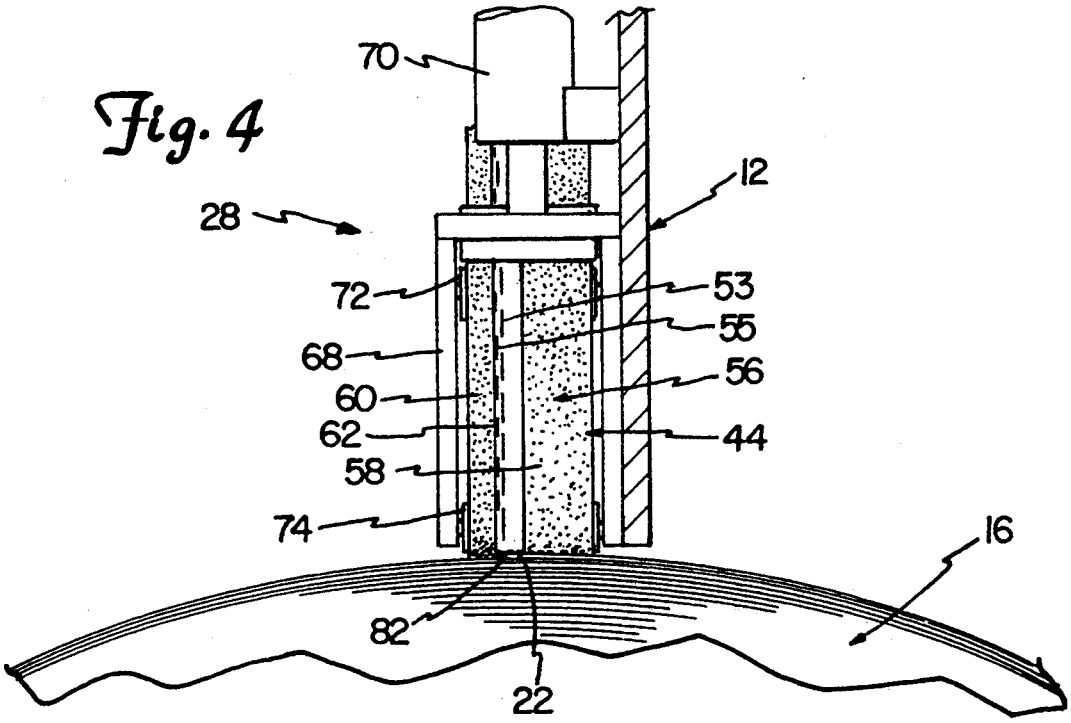
FIG. 4 is a sectional view taken along line 4—4 in FIG. 2.

FIGS. 4 and 5 more clearly show the preferred application of the bottom surface 56 of the tape 44 upon the roll of web material 16. As seen in FIG. 4, the leading edge 22 of the web material 16 is preferably disposed within the leading edge untackified or detackified portion 62 of the tape 44 immediately adjacent the leading edge tackified portion 58. As will be discussed below, the application apparatus 10 is configured to apply the tape 44 in this preferred position.

The following describes the mechanisms used to apply the pressure sensitive, flying splice adhesive tape 44 to the roll of web material 16, as well as the mechanisms used to remove the liner 48 from the tape 44. As seen in FIGS. 1, 2 and 6, the roll of tape 49 is positioned upon the supply mechanism 26. The supply mechanism 26 is essentially a hub 64 rotatably mounted on the application frame 12. A friction brake (not shown) is disposed on the hub 64 to ensure that the tape 44 and the liner 48 remain taut as they extend first around a first idler roller 65 then around a constant tension roller 66 and then to the application mechanism 28.

As seen in FIG. 2, the application mechanism 28 places the tape 44 upon the roll of web material 16 as the application frame 12 moves in the second linear direction B. As seen best in FIG. 3, the application mechanism 28 includes a support bracket 68 that is attached to a first linear actuator mechanism 70 (e.g., a pneumatic-driven piston/cylinder actuator). The linear actuator mechanism 70 is activated by the controller 37 to selectively place the support bracket 68 in either an operative position (adjacent the leading edge 22 of the roll of web material 16, as shown in FIG. 2) or a non-operative position (spaced from the roll of web material 16, as shown in FIG. 1). An upper roller 72 and a lower application roller 74 are rotatably mounted to the support bracket 68 to guide and align the tape 44. As illustrated schematically in FIG. 1, the upper roller 72 is driven (in the direction of arrow 69) by a drive motor 75. The lower application roller 74 is also driven (in the direction of arrow 71) by the drive motor 75. Operation of the drive motor 75 is controlled by the controller 37. The upper and lower application rollers 72 and 74 are driven by the drive motor 75 (as controlled by the controller 37) through an adjustable clutch 73 that preferably provides a substantially constant torque to the upper and lower application rollers 72 and 74 via a drive belt assembly 67. The upper roller 72 when driven by the drive motor 75 through the clutch 73 acts to remove the tape 44 with liner 48 from the supply mechanism 26.

The take-up mechanism 30 works in conjunction with the application mechanism 28 to remove the liner 48 from the tape 44. The take-up mechanism essentially is comprised of a take-up spool 76 that is driven by a drive motor 77, through a friction clutch (not shown), which is controlled by controller 37. Take-up idler rollers 78 and 80 are positioned between the take-up mechanism 30 and the application mechanism 28 to provide a path for the liner 48. The take-up roller 76 provides a means for removing the liner 48 from the tape 44 as the tape 44 exits the application mechanism 28.

Figure 3:
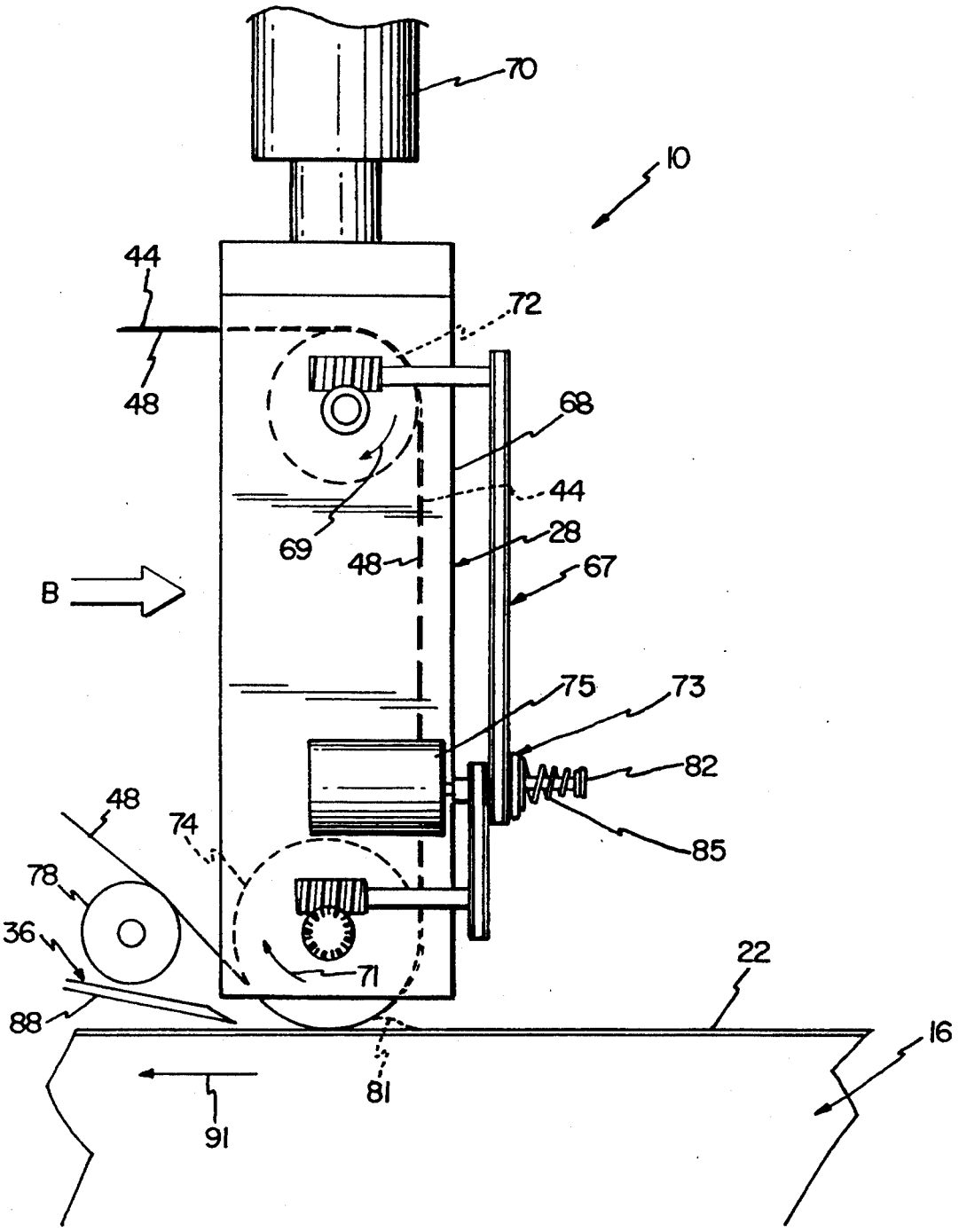
FIG. 3 is an enlarged elevational view of the application mechanism shown in FIGS. 1 and 2.

FIGS. 3 and 4, show the application mechanism 28 in its operative position. As seen best in FIG. 3, the lower application roller 74 presses the bottom surface 56 of the tape 44 against the roll of web material 16. The tape 44 is automatically aligned with the leading edge 22 during the application step because the application mechanism 28 follows the same linear path as the cutting mechanism 32 that formed the leading edge 22 (and the roll of web material 16 is held stationery). Accordingly, the application apparatus 10 eliminates any misalignment of the tape 44 relative to the leading edge 22 of the roll of web material 16. FIG. 3 further shows the preferred application of the tape 44, wherein the leading edge 22 of the web material 16 is disposed within the leading edge untackified or detackified portion 62 of the tape 44 immediately adjacent the leading edge tackified portion 58.

The upper and lower application rollers 72 and 74 are driven by the motor 75 through the adjustable clutch 73 and controlled by the controller 37 so that they rotate to provide a peripheral roll speed substantially matching the linear movement of the application frame 12 along the roll of web material 16 during the tape application step.

The adjustable clutch 73 preferably comprises a magnetic particle clutch, as are commercially available, because such a magnetic particle clutch will transmit torque to the rollers essentially independent of roller speed. Preferably, the motor 75 is driven at a greater speed than that of the rollers 72 and 74, but the controlled slippage of the adjustable clutch 73 (i.e., magnetic particle clutch) provides the desired torque to the rollers 72 and 74, and provides the desired speed match of the roller peripheral speed to the surface speed along the roll of web material 16. It is to be understood that other types of clutches could be used, and that other clutches, such as a friction clutch, could be even more suitable for use depending on the circumstances of application.

During the application of the tape 44 to the leading edge 22, a ridge (as represented by dashed lines 81 in FIG. 3) of web material ahead of the lower application roller 74 may be created which may cause wrinkling of the tape 44 and web material 16 preventing the leading edge tackified portion 58 of the tape 44 from properly adhering to the leading edge 22 of the roll of web material 16. The leading edge ridge 81 is due primarily to pressure applied by the lower application roller 74 against the leading edge 22 via linear actuator mechanism 70. Basically, the greater the applied pressure, the more torque that is needed to prevent wrinkling. To prevent the formation of the leading edge ridge 81 ahead of the lower application roller 74 the amount of torque applied to the application roller 74 is adjustably controlled at the clutch 73. A positive torque should be applied to the roller 74 beyond that which is minimally necessary for the roller 74 to rotate at the same speed as the linear movement along the web material 16. The torque needed is functionally that which will prevent wrinkling of the leading edge 22 35 depending on the pressure applied by the lower application roller 74. Too high a torque, however, may also have a deleterious effect and may cause wrinkles to form ahead of the roller 74. The torque is preferably constant, however, it may be variable in accordance with the circumstances. What is important is that the torque be controlled so that the lower application roller 74 prevents wrinkling under its applied pressure. In the case of a magnetic particle clutch, the torque is varied by varying the voltage delivered to the clutch. In the case of a friction clutch as schematically shown in FIG. 3, torque is varied by tightening the clutch screw 82 which compresses the spring 85 and increases the torque applied by the roller 74, while loosening the clutch screw 82 releases the spring 85 and thereby decreases the amount of torque applied by the roller 74. Torque applied through the lower application roller 74 acts to pull the web material of the leading edge 22 in the direction of arrow 91 putting tension on the web material and thereby substantially eliminating the leading edge ridge 81. Torque applied through the lower application roller 74 is adjusted at the magnetic particle clutch 73 to compensate for differences in splicing tape properties, differences in web material properties and application apparatus setup parameters to eliminate wrinkles in the web material 16.

The arced shape of the roll of web material 16 and the cylindrical shape of the lower application roller 74 may not allow the outer layer tackified portion 60 of the tape 44 to properly adhere to an outer layer portion 82 of the roll of web material that is directly adjacent the leading edge 22 of the roll of web material 16. Therefore, the buffing mechanism 34 is provided to ensure contact between the outer layer tackified portion 60 and the outer layer portion 82. The buffing mechanism 34 includes a buffing roller 83 freely rotatably mounted to a support element 84. The support element 84 is connected to a second linear actuator mechanism 86 (e.g., a pneumatic-driven piston/cylinder actuator). The second linear actuator mechanism 86 is operated by the controller 37, to selectively place the support element 84 in either an operative position shown in FIG. 2 or a non-operative position shown in FIG. 1. FIG. 5 also shows the buffing mechanism 34 in its operative position, where the buffing roller 83 contacts the trailing edge untackified or detackified portion 54 to ensure proper contact between the outer layer tackified portion 60 of the tape 44 and the outer layer portion 82 of the roll of web material 16.

FIG. 6 illustrates the application apparatus 10 in its tape cutting position. The tape cut-off mechanism 36 includes a cutting blade 88 that is connected to a third linear actuator mechanism 90 (e.g., a pneumatic-driven piston/cylinder actuator). The third linear actuator mechanism 90 is controlled by the controller 37 to selectively activate the tape cut-off mechanism 36. The cutting blade 88 is normally in a retracted position spaced from the tape 44 and lower application roller 14, as seen in FIGS. 1 and 2. To sever the tape 44, the third linear actuator mechanism is activated to move the cutting blade 88 into the position shown in FIG. 5 when the lower application roller 74 is adjacent an outer end edge 92 of the roll of web material 18. Only the tape 44 is cut by the cutting blade 88, not the liner 48. After the cut is made, the application frame 12 continues to move in direction "B" to complete the buffing procedure by buffing roller 83.

The inventive application apparatus 10 disclosed herein provides an automated means for applying pressure sensitive flying-splice adhesive tape 44 to the roll of web material 16. The application apparatus 10 provides a means for forming the precise leading edge 22 upon the roll of web material 16, as well as a means for applying the tape 44 upon the roll of web material 16 such that the tape 44 is automatically properly aligned with the leading edge 22. Moreover, the formation of the leading edge 22 and tape application occur while the rough edge portion 43 of the web material 16 is maintained in its position relative to the roll of web material 16. This advantageously minimizes the possibility of misalignment of the taped leading edge of the web material 16 for the splicing operation to an expiring roll. The use of magnetic particle clutch 73 for providing a controlled and preferably constant torque at the lower application roller 74 insures that leading edge 22 of web material 16 beneath the tape 44 is wrinkle free. In addition, the application apparatus 10 provides a means for removing the liner 48 from the adhesive tape 44 prior to or during the application of the tape 44 along the leading edge 22. Furthermore, the tape cut-off mechanism 36 automatically cuts the tape 44 after it has been applied to the leading edge and the buffing mechanism 34 ensures that the tape 44 is positively adhered to the outer layer portion 82 of the roll of web material 16 along its entire length. Moreover, the application of the tape 44 using application apparatus 10 is quicker than prior manual or automated processes for applying splice tape.

Although the present invention has been described with reference to preferred embodiments, workers skilled in the art will recognize that changes may be made in form and detail without departing from the spirit and scope of the invention. In particular, one skilled in the art will recognize that the application apparatus 10 can be adapted to apply a variety of pressure sensitive adhesive tapes. In addition, one skilled in the art will recognize that the cutting mechanism 32 and application mechanism can be adapted to operate sequentially such that the leading edge 22 is cut and the tape 44 applied in a single direction pass of the application frame 12. In addition, one skilled in the art will recognize that the lower application roller 74 could comprise a first idler application roller (over which the tape 44 passes and which applies the tape 44 to the leading edge 22); and a second driven application roller (which is ahead of the idler application roller as defined by the direction of travel of the application frame) which is driven by a motor through a magnetic particle clutch at a constant torque to insure a wrinkle free leading edge 22 of web material 16 ahead of the idler application roller. Moreover, one skilled in the art will recognize that the lower application roller 74 could comprise an idler application roller that is spaced from the leading edge 22 of web material and is followed by (as defined by the direction of travel of the application frame) a driven, buffing-type, application roller which is driven through a magnetic particle clutch at a constant torque to insure a wrinkle free leading edge 22 of web material 16.

What is claimed is:

1. An apparatus for applying a length of adhesive tape from a supply of adhesive tape along the length of a leading edge of a roll of web material, comprising:

a main frame;

an application frame assembly mounted on the main frame and configured to be positioned adjacent to a leading edge of a roll of web material, the application frame assembly including:

a support means for holding a supply of adhesive tape;

an application means for removing adhesive tape from the supply of adhesive tape and for applying a length of adhesive tape along a length of the leading edge of the roll of web material, said application means including an application roller for applying the length of adhesive tape to said leading edge at an applied pressure;

means for driving the application roller at a predetermined speed;

and means coupled to the drive means for applying a variable controlled torque to the application roller which is in addition to that which is necessary to rotate the application roller at the predetermined speed, sufficient to prevent wrinkling of the web material at said applied pressure.

2. The application apparatus of claim 1 wherein the means for driving the application means is a drive motor and wherein the means for applying a controlled torque includes:

a clutch mechanism for coupling the drive motor to the application roller and for delivering a desired controlled torque to the application roller to prevent formation of a web material ridge ahead of the application means and permit a uniform application of a length of adhesive tape along a length of the leading edge of the roll of web material.

3. The application apparatus of claim 1, and further including:

means for moving the application frame assembly relative to the main frame and the roll of web material, to permit linear movement of the application frame assembly relative to the main frame in a direction parallel to the length of the leading edge of the roll of web material.

4. The application apparatus of claim 3 wherein the means for moving the application frame assembly further includes:

a drive mechanism adapted to drive the application frame assembly in a first direction along the length of the leading edge of the roll of web material and in a second direction opposite to the first direction back along the length of the leading edge.

5. The application apparatus of claim 1, and further including:

means for moving the application frame assembly relative to the main frame in a first linear direction along a length of the roll of web material and in a second linear direction opposite to the first direction back along the length of the roll of web material.

6. The application apparatus of claim 5 wherein the application frame assembly further includes:

cutting means adapted for cutting the length of web material to form a length of leading edge on the roll of web material, the cutting means acting to form the length of leading edge as the moving means moves the application frame assembly in the first linear direction along the length of the roll of web material.

7. The application apparatus of claim 6 wherein the cutting means includes:

a circular cutting blade; and a drive motor coupled to the cutting blade for rotating the circular cutting blade at a speed sufficient to cut the length of web material to form the length of leading edge on the roll of web material.

8. The application apparatus of claim 7 wherein the cutting means further includes:

a cutting guide adjacent to the cutting blade, the cutting guide being configured to support a portion of the length of web material to effect contact between the rotating cutting blade and the continuous length of web material as the application frame assembly travels in the first linear direction along the length of the roll of web material.

9. The application apparatus of claim 5 wherein the supply of adhesive tape is a supply of adhesive tape adhered to a liner and wherein the apparatus further includes:

take-up means for removing the liner from the adhesive tape adhered to the liner during the application of the adhesive tape along the length of the leading edge of the roll of web material.

10. The application apparatus of claim 9 wherein the application means includes:

an application mechanism movable between an application position, wherein adhesive tape adhered to a liner is removed from the supply of adhesive tape adhered to a liner and wherein a length of adhesive tape that is free from a liner is applied along the length of the leading edge of the roll of web material, and an non-operative position wherein no removal of adhesive tape or application of adhesive tape occurs.

11. The application apparatus of claim 10 wherein the means for applying a controlled torque to the application means includes a drive motor and wherein the application mechanism includes:

a support bracket movable between the application position and the non-operative position;

an upper roller mounted on the support bracket, the upper roller being coupled to and driven by the drive motor such that upon operation of the drive motor, in the application position of the support bracket, the upper roller removes adhesive tape adhered to a liner from the supply of adhesive tape adhered to a liner; and said application roller mounted on the support bracket and spaced below the upper roller, the application roller being coupled to and driven by the drive motor such that upon operation of the drive motor, in the application position of the support bracket, the application roller applies a length of adhesive tape that is free from a liner along the length of the leading edge of the roll of web material.

12. The application apparatus of claim 11 wherein the means for applying a controlled torque to the application means further includes:

a clutch mechanism for coupling the drive motor to the application roller and for delivering a desired controlled torque to the application roller to prevent formation of a web material ridge ahead of the application means and permit a uniform application of a length of adhesive tape that is free from a liner along a length of the leading edge of the roll of web material.

13. The application apparatus of claim 12 wherein the clutch mechanism is an adjustable magnetic particle clutch.

14. The application apparatus of claim 11 wherein the application mechanism further includes:

means for linearly moving the support bracket between the application position wherein the lower application roller is directly adjacent the leading edge of the roll of web material and the non-operative position wherein the lower application roller is spaced from the leading edge of the web material.

15. The application apparatus of claim 14 wherein the means for linearly moving the support bracket includes a linear actuator.

16. The application apparatus of claim 10 wherein the application mechanism further includes:

a buffing mechanism movable between a buffing position, wherein the buffing mechanism contacts the adhesive tape applied along the length of the leading edge of the roll of web material to insure contact between the adhesive tape and an outer layer portion of the roll of web material that is directly adjacent the leading edge of the roll of web material, and a non-operative position wherein the buffing mechanism is spaced from the adhesive tape applied along the length of the leading edge.

17. The application apparatus of claim 16 wherein the buffing mechanism includes:

a support element linearly movable between the buffing position and the non-operative position; and a buffing roller, freely, rotatably mounted on the support element, the buffing roller, in the buffing position of the support element, contacting the outer layer portion of the roll of web material that is directly adjacent the leading edge of the roll of web material.

18. The application apparatus of claim 17 wherein the means for linearly moving the support element includes a linear actuator.

19. The application apparatus of claim 16 wherein each of the application mechanism and the buffing mechanism is in its respective non-operative position when the application frame assembly is traveling in the first linear direction along the length of the roll of web material, and wherein the application mechanism and the buffing mechanism are in the application position and buffing position, respectively, when the application frame assembly is traveling in the second linear direction back along the length of the roll of web material.

20. The application apparatus of claim 5 wherein the application frame assembly further includes:

a cutoff means for cutting the adhesive tape subsequent to the adhesive tape being applied to the leading edge of the roll of web material to form the length of adhesive tape along the leading edge of the web material.

21. The application apparatus of claim 20 wherein the cutoff means includes:

a cutoff blade linearly movable between a cutoff position wherein the cutoff blade cuts the adhesive tape to form the length of adhesive tape and a non-operative position wherein the cutoff blade is spaced from the adhesive tape and no cutting occurs; and a linear actuator for linearly moving the cutoff blade between the cutoff position and the non-operative position.

22. The application apparatus of claim 9 wherein the take-up means includes:

a take-up member for holding the liner removed from the adhesive tape adhered to the liner; and a drive motor coupled to the take-up member for driving the take-up member to remove the liner from the adhesive tape adhered to the liner during the application of the adhesive tape along the length of the leading edge of the roll of web material.

* * * * *